United States Patent [19]

Gainer

[11] 4,302,944

[45] Dec. 1, 1981

[54] THERMAL STORAGE METHOD AND APPARATUS

[75] Inventor: Gordon C. Gainer, Penn Hills Township, Allegheny County, Pa.

[73] Assignee: Westinghouse Electric Corp., Pittsburgh, Pa.

[21] Appl. No.: 169,055

[22] Filed: Jul. 15, 1980

[51] Int. Cl.[3] ..... F25D 3/00; F25D 17/02; F25D 11/00

[52] U.S. Cl. ..... 62/59; 62/99; 62/430; 62/434

[58] Field of Search ..... 62/393, 430, 434, 79, 62/59, 118, 98, 99

[56] References Cited

U.S. PATENT DOCUMENTS

| | | | |
|---|---|---|---|
| 1,943,268 | 1/1934 | Fleischer | 62/59 X |
| 1,963,698 | 6/1934 | Garre, Jr. | 62/434 X |
| 1,968,195 | 7/1934 | Fleischer | 62/59 X |
| 2,095,008 | 10/1937 | Philipp | 62/59 |
| 2,292,692 | 8/1942 | Huber | 62/434 X |
| 2,779,171 | 1/1957 | Lindenblad | 62/434 X |
| 2,990,693 | 7/1961 | Houplain | 62/59 X |
| 3,156,101 | 11/1964 | McGuffey | 62/430 X |
| 3,228,205 | 1/1966 | Franklin | 62/430 X |
| 3,247,678 | 4/1966 | Mohlman | 62/185 X |
| 3,257,818 | 6/1966 | Papapanu | 62/185 X |

*Primary Examiner*—Lloyd L. King
*Attorney, Agent, or Firm*—E. C. Arenz

[57] ABSTRACT

A local delivery truck 10 is provided with a thermal storage system for cooling the truck for a delivery run after the system has been charged during periods of off-peak power demand. This is done by chilling, with a refrigerant evaporator 32, a first high density fluid 24 such as methyl chloroform and circulating the chilled methyl chloroform from the lower part 22 of the storage container 20 to the surface of a second, lower density fluid 28. the latter is an anti-freeze solution such as water-methyl alcohol, and occupies the upper part 26 of the storage container. The chilling and circulating continues until the anti-freeze solution contains the desired amount of ice and slush which has formed at ever lowering temperatures.

13 Claims, 3 Drawing Figures

THERMAL STORAGE METHOD AND APPARATUS

BACKGROUND OF THE INVENTION

1. Field of the Invention:

This invention relates to thermal storage generally, and particularly to a method and apparatus for producing and using low temperature storage ice. While the invention is not limited thereto, it is considered particularly applicable for employment in connection with short-haul delivery trucks which do not have a self-contained mechanical refrigeration system but which carry items requiring a chilled space.

2. Description of Prior Art:

Transportation of perishable products, such as meat for example, generally requires maintaining such products in a chilled condition to prevent undue spoilage. While it is relatively easy to justify economically the provision of large, long haul trailers with self-contained transport refrigeration units, it is harder to justify equipping a fleet of small, local delivery trucks with self-contained mechanical compression refrigeration systems. Also, since self-contained systems are dependent on increasingly more expensive and scarce gasoline or diesel fuel as the energy source, the ever increasing operating costs for such small trucks having a self-contained refrigeration system also enters the picture. Accordingly, it is desirable to develop a practical thermal storage system for these small trucks which would effectively be charged during night periods and/or off-peak electrical power times, and would be used or discharged in truck delivery during the daytime or other peak electrical demand periods.

It is recognized that ice is a desirable thermal storage medium, not only because it is low in cost but largely because, of all possible systems, the water-to-ice phase change normally occurring at 0° C. involves virtually the highest known heat of fusion (being about 79.71 calories per gram). It has been recognized also that water in an anti-freeze solution can be used to form ice, as taught in U.S. Pat. No. 2,101,953. The direct approach to making ice consists in operating a refrigerated evaporator at a low temperature while submerged or in contact with an anti-freeze solution. Problems arise with such an arrangement, however, in that ice formation almost immediately forms and coats the cold evaporator coils and chilling surfaces. Thus further heat exchange or chilling of the anti-freeze solution is greatly impaired unless some means is provided for scraping the ice off the cooling surface, as is disclosed in the noted patent. Alternately, if an anti-freeze solution is chosen which has a very high anti-freeze component level such that no freezing out of ice occurs, then advantage cannot be taken of the high heat absorbed in the phase change involving the conversion of water to ice.

Another known thermal storage system is disclosed in U.S. Pat. No. 2,996,894, which avoids the problems of ice formation upon an evaporator coil by utilizing different density fluids such as oil and water which are immiscible with each other. Here ice is formed by contact of cold chilled oil with the water. In one embodiment the oil is chilled and contacted with water to form ice, thus effecting the thermal storage medium. Subsequently, when utilization of the ice is desired by chilling from the thermal storage reservoir, the oil can be pumped to contact the ice and chilling can occur by virtue of ice melting utilizing the heat of fusion of the ice. In another embodiment in the above patent, disodium phosphate is provided in aqueous solution, with the disodium phosphate precipitating out at a predetermined temperature. Such an arrangement is considered to have the disadvantage of being substantially limited in the extent of depression in temperature (lowering of freezing point of water) that can be accomplished through the precipitation of the disodium phosphates. This is because of the relatively low solubility of disodium phosphate in water.

It is the aim of my invention to avoid the problems associated with prior art arrangements, and in particular to provide a method and apparatus for thermal heat storage employing a high density, low viscosity chilling fluid which, when used, is capable of operation at extremely low temperatures, e.g., as low as −40° F. (−40° C.). Additionally, in its preferred application, the system has been developed for operation in small transport truck an application which permits the thermal storage of ice to be built-up during off-peak power periods.

SUMMARY OF THE INVENTION

In accordance with the invention the thermal storage or ice making method is carried out by chilling a high density, low viscosity first fluid which has communication with the lower space in an insulated container, and circulating the first fluid in a circuit to the surface of a second fluid which is an anti-freeze solution of lower density than the first fluid and immiscible therein, the lower density fluid occupying the higher space in the container, continuing the chilling and circulating until the temperature of the second fluid has decreased enough that sufficient slush ice of a desired low temperature is formed from anti-freeze solution. As chilling continues, temperature will decline and ice will separate at ever lowering temperatures. The stored ice is then utilized by discontinuing the chilling and circulating the chilled first fluid alone to a cooling coil in a space to be cooled in the truck to pick up therefrom and return the warmed first fluid to the surface of the second fluid containing the slush ice so that the first fluid will be chilled by the ice slush and percolate downwardly by virtue of its high density.

The currently preferred first fluid is methyl chloroform and the anti-freeze solution is methyl alcohol and water.

In one form of the invention, as applied to a truck, only the insulated container with the fluids and the piping for circulating the one high density fluid to the space to be cooled is carried by the truck. The base refrigerating system including compressor, condenser, and evaporator, with piping for connection to the thermal storage container, may be disconnected from the storage system. In another embodiment, the refrigerant evaporator is located in the lower part of the thermal storage container in the truck and is permanently connected to the compressor and condenser of the refrigeration system so that the entire refrigeration system accompanies the truck on its travel. Electrically driven units are electrically disconnected (unplugged) prior to travel.

DRAWING DESCRIPTION

DESCRIPTION OF THE PREFERRED EMBODIMENTS

Figure 1:
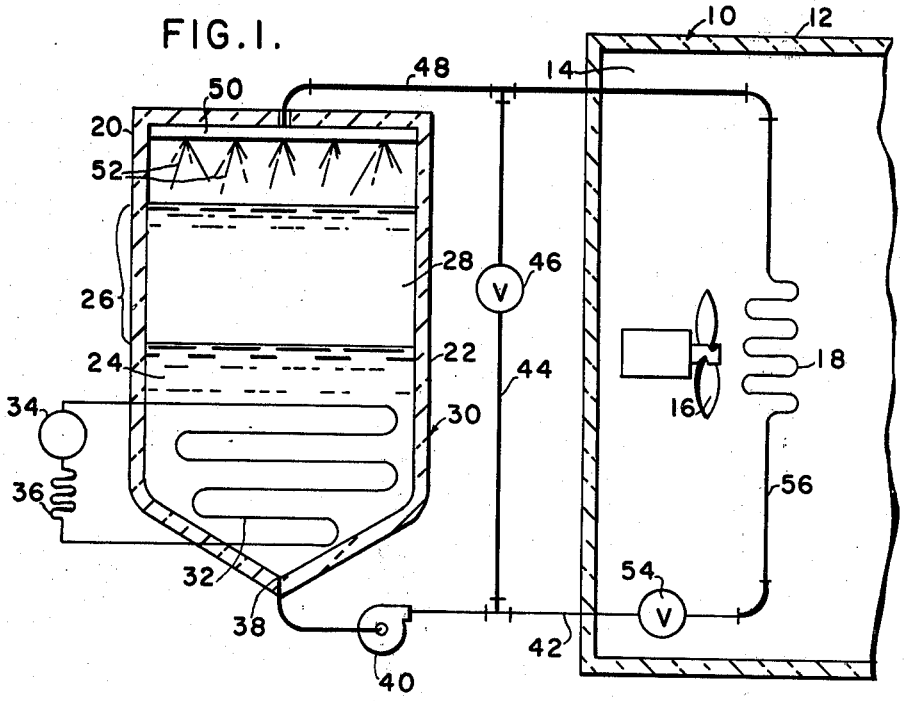
FIG. 1 is a schematic illustration of one embodiment of the invention.

Referring to FIG. 1, the arrangement includes a refrigeration system for a small, local delivery truck 10 having thermally insulated walls 12 enclosing an interior space 14 which, when filled with perishable produce to be refrigerated, is adapted to be cooled by circulating interior air from fan 16 over cooling coil 18.

The cooling medium is derived from the thermally insulated storage container 20 which contains in its lower space 22 a high density, low viscosity first fluid 24. An upper part of the space in the container indicated by the bracket 26 contains a second fluid 28 comprising an anti-freeze solution of lower density than the first fluid and essentially immiscible therein.

The lower part 30 of the lower space 22 contains a refrigerant evaporator coil 32 which is connected in conventional manner to the remainder of the refrigerant system comprising a compressor 34 and condenser 36 along with a refrigerant expansion device (not shown).

The bottom outlet 38 of the container is connected to a first circuit comprising in sequence pump 40, conduit 42, conduit 44 with valve 46 therein, and conduit 48 leading back to the top of the container and connected to a manifold 50 provided with spray means 52 above the surface of the second fluid. A second circuit or loop to which the first medium can be passed by pump 40 includes in sequence the conduit 42, valve 54, conduit 56 which includes the cooling coil 18 and then conduit 48 leading back to the manifold 50.

The currently preferred first high density fluid 24 is methyl chloroform (1,1,1-trichloroethane). The currently preferred anti-freeze solution which forms the lesser density second fluid is a solution of water and methyl alcohol.

The way the system works is as follows. Assume the truck is at its home base during a period of off-peak power costs, such as at night, and it is desired to obtain the thermal storage for the system for use the next day in the truck. The valves 46 and 54 are placed in positions so that the pump 40 will pump the first fluid 24 through the first circuit and back to the surface of the anti-freeze solution. The refrigerating system is made operative by energizing the compressor 34 to obtain the refrigerating or chilling effect in the evaporator coil 32. The refrigerating system is designed to produce a very low temperature in the evaporator coil 32, such as −40° F. (−40° C.). The evaporator being submerged in the high density first fluid chills this fluid which is then pumped in the first circuit and directed onto the surface of the anti-freeze solution. At this location, liquid-to-liquid heat transfers occur and in effect the anti-freeze solution becomes chilled by the intimate mixing of the cold high density immiscible first fluid with the anti-freeze solution. Because of the high density of the first fluid and because it is immiscible, it will settle to the bottom of the container where it is recirculated again over the cold cooling coils of the evaporator to continue repetition of the cycle. The sloped bottom of the container is considered to be an aid in collecting the high density fluid and if desired some baffling may be provided.

As chilling progresses, the temperature of the anti-freeze solution will be lowered until ice begins to separate as a slush in the anti-freeze solution. As the ice separates from the anti-freeze solution, that solution will become richer with respect to the anti-freeze component (that is methyl alcohol in the preferred form), and the ice separating temperature (the eutectic melting point) will become progressively lower, the slush ice being in thermal equilibrium with the entire mass, until a desired sub-zero temperature of the entire contents of the container has been attained. In other words, this will indicate that the desired amount of ice has been produced as a slush in the sub-zero anti-freeze solution. Depending upon the particular application, such sub-zero temperature may be in the order of say, −10 to −40° F. (−23°−−40° C.).

The mechanical refrigerating system is then shut down, and the stored ice and cold first fluid are now available for use for cooling the truck interior. Assuming the truck is loaded and is to be maintained refrigerated, the valves 44 and 56 are changed (44 closed, 56 open) to positions in which the first high density medium 24 is pumped by pump 40 through the second circuit which includes the cooling coil 18 which is chilled by the first fluid. The fan 16 blows air over the coils 18 to chill the interior of the truck, and the somewhat warmed first fluid returns to the container 20 and is sprayed onto the surface of the anti-freeze-ice-slush mixture. The subzero ice will progressively melt, thereby chilling the incoming high density fluid which percolates in the chilled condition to the bottom of the tank for recirculation through the second circuit. It will be appreciated again that direct contact liquid-to-liquid heat exchange has been effected between the first and second fluids.

Figure 2:
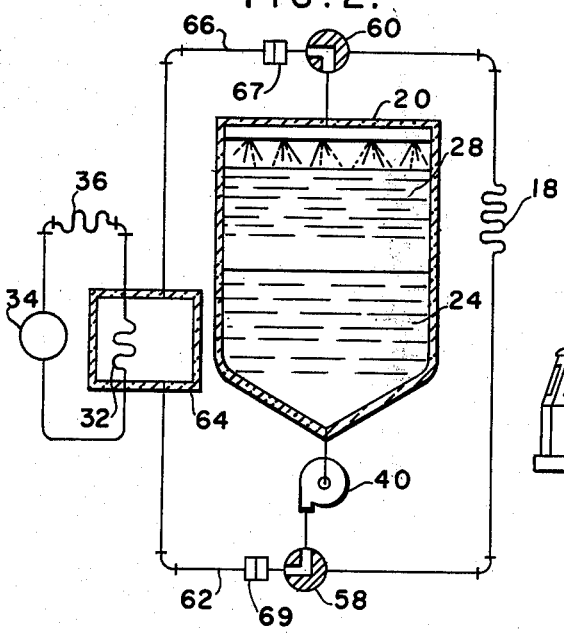
FIG. 2 is a schematic illustration of another embodiment of the invention.

The system of FIG. 2 is arranged so that the refrigerating mechanism does not accompany the truck while the thermal container 20 does. In FIG. 2, items which are common with those of FIG. 1 are given identical numerals.

In FIG. 2, valve means 58 at the outlet and valve means 60 at the inlet to the thermal storage container 20 are provided, these valve means being shown in the form of two-way valve means which permits the first dense fluid 24 to be pumped through conduits 62 to a refrigerating cooler 64 containing refrigerant evaporator 32 and back through conduit 66 to the surface of the second fluid 28 in the storage container. After the desired quantity of slush ice has been formed in the second fluid 28 at the desired low temperature, the conduits 64 and 66 are disconnected from the remainder of the storage system through the sealing disconnect means 68 and 70. With valves 58 and 60 directed to positions opposite from that shown in FIG. 2 high density fluid 24 will be pumped to the cooling coils 18 in the truck to refrigerate the interior. In other respects, the system is the same as in FIG. 1.

Figure 3:
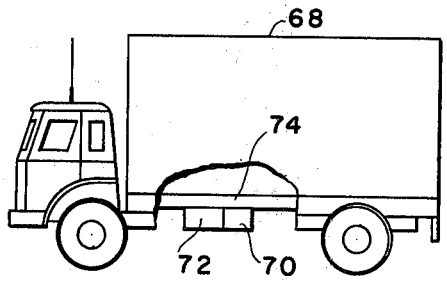
FIG. 3 is a side view of the type of truck to which the invention may be applied, showing the thermal storage system installed in one location considered preferable by some.

In FIG. 3, a truck 68 of the general type with which the invention is concerned is shown with the apparatus shown in block form in one particular arrangement. The mechanical refrigeration part 70 and the thermal storage part 72 are both shown in a location under the floor of the truck. With this location, it is conceivable that during charging (ice making storage), an insulated floor panel 74 would be in place during this period. When the truck is to be used for delivery, the panel could be removed to expedite cooling of the truck interior. In that connection it is noted that while in the schematics of FIGS. 1 and 2, the storage container is deliberately shown vertically elongated for purposes of explanation, the storage container can be relatively shallow in depth and still provide adequate layer separation.

Methyl alcohol-water has been noted as the preferred anti-freeze solution, this being in preference to the various well-known brines and salt solutions which are quite corrosive toward many common materials used in refrigerating devices. Additionally, the brines are of a higher density than methyl alcohol, for example, and accordingly, exact a greater weight penalty in achieving a given lowering of the freezing point of water. Other examples of useable anti-freeze solutions include water with other alcohols such as ethyl and propyl, and glycols like ethylene and propylene glycol, may also be used.

Methyl chloroform was noted as an example of a currently preferred high density fluid immiscible in the anti-freeze solutions. One factor in selecting methyl chloroform lies in the fact that it has a high affinity for methyl alcohol, the presence of which will tend to prevent the freezing up or fouling of the cold evaporator coils due to any carry over of the anti-freeze solution arising from any incomplete separation in the settling tank. Further, it is extremely low in cost and in toxicity. The presence of methyl alcohol in the methyl chloroform also serves to lower the freezing of the methyl chloroform (which is −33° C.) to even lower values to permit even lower evaporator temperatures in the freezing cycle. In effect, the lowered tempertures are designed into the liquid system used.

Another liquid which is of high density and is immiscible in the anti-freeze solution and therefore suitable for use in the cycle is R-113 (1,1,2-trichloro-1,2,2-trifluoromethane). It is significantly more costly than the methyl chloroform, but is even lower in toxicity than methyl chloroform.

It is emphasized that in carrying out the practice of the invention it is not simply utilization of the high heat of fusion of water to ice which is utilized but ice is produced at very low temperature, in slush form, by freezing out of low antifreeze solutions at even decreasing temperature. If water alone were used in our system ice could never be produced, stored, and utilized, at any temperature below 0° C. (32° F.).

I claim:

1. The method of creating low temperature ice and then using the latent heat of fusion of the ice for cooling, comprising the steps of:

chilling a high density first fluid which has communication with a lower space in an insulated container;

circulating said chilled first fluid in a first circuit to the surface of a second fluid, said second fluid comprising an anti-freeze solution of lower density than said first fluid and immiscible therein, and occupying a higher space in said container by virtue of its lower density;

continuing said chilling and circulating steps, with said first fluid settling downwardly through said second fluid until the temperature of said second fluid has decreased sufficiently that an adequate quantity of slush ice of a desired low temperature is formed in said second fluid; and then circulating said first fluid to a space to be cooled to pick up heat therefrom and returning the warmed first fluid to the surface of said second fluid containing the ice slush, so that said first fluid will be chilled by said ice slush in percolating downwardly therethrough 2. The method of claim 1 wherein:

said first fluid is directed onto the surface of said second fluid with a force beyond that of gravity.

3. The method of claim 1 wherein:

the chilling of said first fluid in said lower space of said container is carried out by means of a refrigerant evaporator therein.

4. The method of claim 1 wherein:

said first fluid comprises methyl chloroform.

5. The method of claim 4 wherein:

said anti-freeze solution comprises a solution of methyl alcohol and water.

6. Apparatus for creating low temperature ice and then using the latent heat of fusion of the ice for cooling a space, comprising:

a thermally insulated container;

a high density first fluid in the lower space in said container;

a second fluid in the upper space of said container, said second fluid comprising an anti-freeze solution of lower density than said first fluid and immiscible therein;

refrigerant evaporator means for chilling said first fluid;

means for circulating said first fluid to the surface of said second fluid, said first fluid settling downwardly through the second fluid by virtue of their different densities thereby progressively cooling said second fluid;

said means for chilling and means for circulating being operated sufficiently long that the temperature of said second fluid decreases sufficiently that an adequate quantity of slush ice of a desired low temperature is formed; and means for circulating said first fluid to said space to be chilled to pick up heat therefrom and returning the warmed first fluid to the surface of said second fluid containing the ice slush so that said first fluid will be chilled by said ice slush in percolating downwardly therethrough.

7. Apparatus according to claim 6 wherein:

said means for circulating said first fluid to the surface of said second fluid includes a first loop including pump means for drawing said first fluid from said lower space and pumping it up to said upper space.

8. Apparatus according to claim 7 wherein:

said means for passing said first fluid to said space to be chilled includes a second loop, said pump means being common to said first and second loops.

9. Apparatus according to claim 6 wherein:

said refrigerant evaporator is located in said lower space of said insulated container.

10. Apparatus according to claim 6 wherein:

said refrigerant evaporator is located externally of said insulated container; and a fluid circuit is provided including fluid motive means for withdrawing said first fluid from said lower space to said evaporator and forced back to said upper space.

11. For a short haul delivery truck of the type adapted to haul locally items requiring a chilled environment, and having a thermally insulated body to receive said items, a chilling system comprising:

a thermally insulated container carried by said truck;

a high density first fluid in the lower space in said container;

a second fluid in the upper space of said container, said second fluid comprising an anti-freeze solution of lower density than said first fluid and immiscible therein;

a mechanical refrigerating system including an electrically powered compressor, and condenser, and an evaporator for chilling said first fluid when said refrigerating system is energized;

a first full loop for conveying said first fluid from the bottom of said container to the surface of said second fluid and then back down to said lower space, said first fluid settling downwardly through said second fluid because of their different densities, said first loop including pump means and said evaporator, said pump means and said evaporator being operated sufficiently long that the temperature of said second fluid decreases sufficiently that an adequate quantity of said slush ice of the desired low temperature is formed in said second fluid;

a second full loop, operative when said refrigerating system is deenergized and said truck body is to be chilled, said second loop including said pump means, a heat exchanger in said truck body, and pipe means, said pipe means being connected to receive said first fluid from the bottom of said container and pass said first fluid to said heat exchanger, and being connected back to the upper space in said container to return said first fluid to the surface of said second fluid containing said slush ice, said first fluid being chilled by said slush ice and percolating downwardly therethrough to said lower space in said container.

12. A system according to claim 11 wherein:

said mechanical refrigerating system is carried by said truck.

13. The system of claim 11 wherein:

said refrigerating system is separate from said truck; and said first full loop includes means for disconnecting said evaporator from said first full loop.

* * * * *